United States Patent [19]

Koboshi et al.

[11] Patent Number: 4,907,023

[45] Date of Patent: Mar. 6, 1990

[54] AUTOMATIC PROCESSER

[75] Inventors: Shigeharu Koboshi; Hiroyuki Kakuhari; Satoru Kuse; Kazuhiro Kobayashi, all of Hino, Japan

[73] Assignee: Konishiroku Photo Industry Co., Ltd., Tokyo, Japan

[21] Appl. No.: 298,780

[22] Filed: Jan. 17, 1989

Related U.S. Application Data

[63] Continuation of Ser. No. 136,512, Dec. 22, 1987, abandoned, which is a continuation of Ser. No. 21,584, Mar. 2, 1987, abandoned, which is a continuation of Ser. No. 680,737, Dec. 12, 1984, abandoned.

[30] Foreign Application Priority Data

Dec. 16, 1983 [JP] Japan ..... 58-238578
Dec. 16, 1983 [JP] Japan ..... 58-238579

[51] Int. Cl.[4] ..... G03D 3/08
[52] U.S. Cl. ..... 354/321; 354/324
[58] Field of Search ..... 354/298, 316, 319, 320, 354/321, 322, 331; 134/76

[56] References Cited

U.S. PATENT DOCUMENTS

| | | | |
|---|---|---|---|
| 2,933,032 | 4/1960 | Pardee | 134/76 |
| 3,116,677 | 1/1964 | Wetzel | 354/321 |
| 3,195,438 | 7/1965 | Woodcock | 354/321 |
| 3,620,725 | 11/1971 | Kosta . | |
| 3,699,869 | 10/1972 | Jensen | 354/298 |
| 4,185,912 | 1/1980 | Schwartz | 354/316 |
| 4,362,376 | 12/1982 | Otani | 354/319 |
| 4,431,293 | 2/1984 | Riekkinen | 354/322 |

*Primary Examiner*—A. A. Mathews
*Attorney, Agent, or Firm*—Frishauf, Holtz, Goodman & Woodward

[57] ABSTRACT

Disclosed is an automatic processor for processing at least two different kinds of light-sensitive silver halide photographic materials comprising at least one processing tank for commonly processing the light-sensitive materials.

The automatic processor is capable of performing developing processing of different kinds of light-sensitive materials simultaneously.

8 Claims, 4 Drawing Sheets

(a)

(b)

AUTOMATIC PROCESSER

This application is a continuation of application Ser. No. 136,512, filed Dec. 22, 1987 (abandoned); which is a continuation of Ser. No. 21,584, filed Mar. 2, 1987 (abandoned); which is a continuation of Ser. No. 680,737, filed Dec. 12, 1984 (abandoned).

BACKGROUND OF THE INVENTION

This invention relates to an automatic processer for light-sensitive silver halide photographic materials (hereinafter abbreviated as "'light-sensitive materials"), which is capable of performing developing processing of different kinds of light-sensitive materials simultaneously.

At color photographic developing stations, negative light-sensitive materials of negative color films are developed to prepare negative images, which negative images are printed on color papers, thereby forming positive images based on the negative images on the positive light-sensitive materials of the color papers.

According to the developing processing of color photographics of the prior art, three kinds of instruments, namely the automatic processer for the negative light-sensitive material, the automatic processer for the positive light-sensitive material and the automatic printing device, are placed separately. These instruments generally require certain areas for working spaces around the respective instruments, and further spaces required for workings such as supplemental cock adjustment, evaporation correction, tank liquid exchange and supplementing must be ensured.

Accordingly, when the aforesaid instruments are placed separately, it is required that the working spaces around respective instruments should not overlap each other. Such a requirement may result in trouble when workings in a narrow place such as a small scale color developing station. Thus, miniaturization of an automatic processer is now becoming a very important task.

In view of such a background, a processing machine is proposed comprising an integral combination of an automatic processer for color paper and an automatic printing device. However, since a negative light-sensitive material and a positive light-sensitive material are processed with processing liquors separate from each other, the automatic machine for negative light-sensitive material and the automatic machine for positive light-sensitive material are not integrally combined. Heretofore, there have been attempts to develop two different kinds of light-sensitive materials of negative color film and color paper with one processing liquor (solution), and the thought to employ a processing liquor commonly, particularly a developing solution is described in Japanese Provisional Patent Publication No. 32734/1978, Japanese patent Publication No. 35298/1977 and Japanese Patent Publication No. 2779/1978.

Also, Japanese Provisional Patent Publication No. 95342/1983 discloses processing of different kinds of light-sensitive materials of color film and color paper with a developer of the same composition by circulating the developer mutually between the two automatic processers. However, these negative light-sensitive material for photographing and positive light-sensitive for printing comprise silver halide compositions are originally entirely different from each other. No inherent photographic performance can be obtained at all by processing with a developer of the same composition.

Also, for processing of negative light-sensitive material and positive light-sensitive material separately in different automatic processers, in order to perform processing rapidly without waiting time, it is required to always set the processing liquor at a constant temperature and to flow washing water continuously.

Accordingly, it would be very desirable to have an automatic processer capable of performing developing processing of different kinds of light-sensitive materials simultaneously or separately, requiring no broad installation area, which is compact in size and enables saving of energy cost and washing water.

SUMMARY OF THE INVENTION

This invention has been accomplished in view of the state of the art as described above, and it is a first object of this invention to provide an automatic processer for light-sensitive materials, which makes the automatic processer compact by attempting to utilize in common a processing liquor tank and to easily ensure the working space around the automatic processer by saving of the installation area.

A second object of this invention is to provide an automatic processer for light-sensitive materials, which can save the costs required for driving, temperature control and further circulation by attempting to utilize commonly the means for conveying light-sensitive materials, circulation pumps for processing liquors and temperature controlling means.

Further, a third object of this invention is to provide an automatic processer for light-sensitive materials, which employs substantially no washing water and is low in energy cost and the risk of pollution.

The present inventors have made various investigations to achieve the above objects, and it has now been found that the above objects can be accomplished by an automatic processer which is capable of processing at least two different kinds of light-sensitive silver halide photographic materials comprising at least one processing tank for commonly processing commonly said light-sensitive materials in the body of an automatic processer.

The automatic processer of this invention may further comprise processing tanks for processing respectively different kinds of light-sensitive silver halide photographic materials.

Further, according to a more preferable embodiment, the above objects can be accomplished more effectively, when the automatic processer has processing tanks for processing respectively different kinds of light-sensitive silver halide photogrphic materials and processing tanks for general purpose for processing commonly the different kinds of light-sensitive silver halide photographic materials integrally combined in the body of the processer.

Furthermore, the above objects can more effectively be achieved, when the automatic processer has no water washing tank for washing the light-sensitive silver halide photographic materials by flowing of water.

Still further, the above objects can more effectively be achieved, when the automatic processer has no heatexchange type cooling means with water at the color developing tank.

Still further, the above objects can more effectively be achieved, when the automatic processer has at least one processing tank other than the color developing tank, in which the processing temperature is lower by 3° C. or more than that in the color developing tank.

DESCRIPTION OF THE PREFERRED EMBODIMENTS

Figure 1:
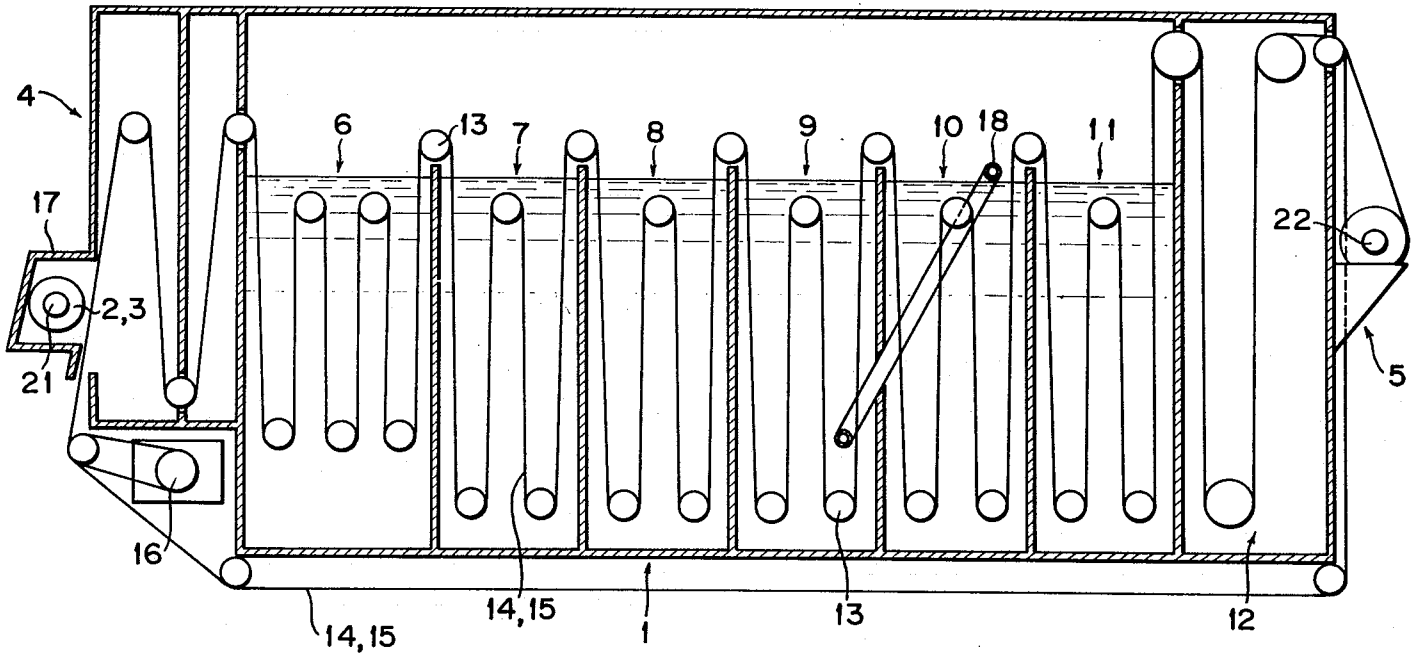
FIG. 1 is a sectional view of an embodiment of the automatic processer according to this invention.

In this invention, by "different kinds of light-sensitive silver halide photographic materials", is meant a combination of different kinds of light-sensitive silver halide photographic materials such as a color negative film and a color paper, a color reversal film and a color reversal paper, a color negative film and a color X-ray film, a silver halide color direct positive film and a silver halide color paper, etc.

Also, in this invention, by "water washing tank for washing of light-sensitive silver halide photographic materials by flowing of water" is meant a tank in which water is supplemented and the amount of the water supplement is in excess of 6000 ml per 1 $m^2$ of the light-sensitive material. Accordingly, the processing tank for rinsing with a small amount of water not more than 6000 ml per 1 $m^2$ of the light-sensitive material or surface washing with sponge, etc. is not included in the water washing tank as mentioned in this invention.

The processing steps for the automatic processer of this invention may employ any of the processing steps already known in the art. In the following, typical examples are set forth, but this invention is not limited thereto.

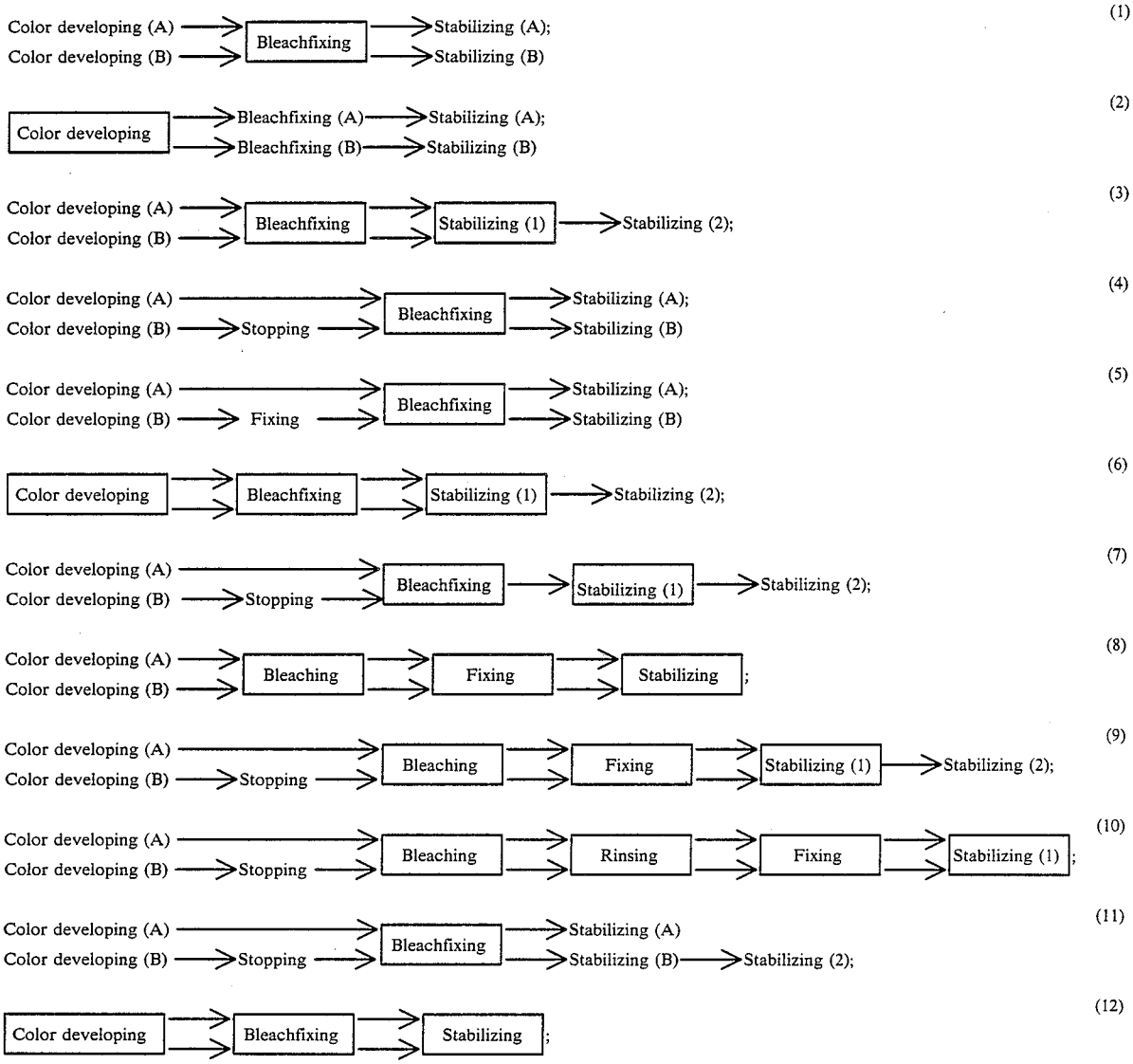

-continued (13)

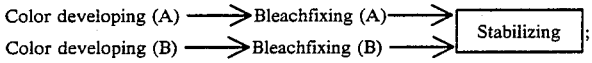

(14)

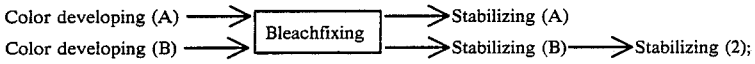

(15)

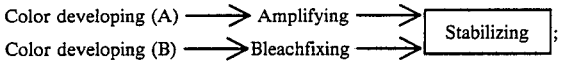

(16)

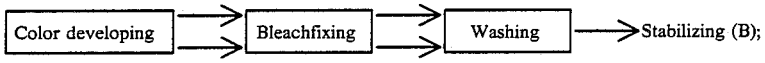

(17)

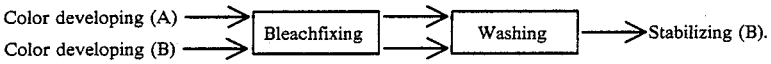

Among these processing steps, the steps surrounded by the rectangles represent common processing steps.

These processing steps (1) to (17) as mentioned above are illustrated the processing steps in which an exposed silver halide color paper (A) and an exposed silver halide color negative film (B) are processed by the automatic processor of this invention.

Next, typical examples of the processing steps in which an exposed silver halide direct positive film (C) and a silver halide color paper (D) are processed by the automatic processor of this invention are set forth below.

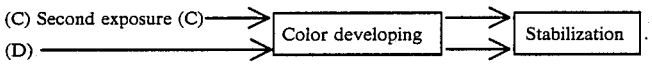

The representations A and B following the respective steps refer to the processing steps corresponding to the two kinds of light-sensitive materials A and B to be processed.

In the automatic processer of this invention, they may be also included in this invention wherein the processers having constitutions in which each of two different kinds of photographic materials are processed, is separately processed or processing liquors are mutually communicated with each other. More specifically, communicating means of the processing liquors may have the constitution wherein an overflowed processing liquor flows into an other processing tank or processing liquors are mutually circulated through a pipe by using a pump.

The processing liquors to be used in the respective processing steps may include those conventionally used in the technical field for processing of the light-sensitive silver halide photographic materials. For example, the color developing solution to be used in the color developing processing step may contain a p-phenylenediamine derivative as the color developing agent. The bleaching solution to be used in the bleaching processing step is a processing liquor for converting silver such as of a silver image into a silver halide, and an oxidizing agent such as EDTA iron chelate may be employed. The bleach-fixing solution to be used in the bleach-fixing processing step is a processing liquor for bleaching of the silver image simultaneously with fixing, and it may contain a bleaching agent such as an EDTA iron chelate and a fixing agent such as a thiosulfate, etc. The fixing solution to be used for the fixing processing step is a processing liquor for dissolving away the silver halide remaining in the emulsion layer of the light-sensitive material after development for stabilization against the light, and it may contain a fixing agent such as a thiosulfate. The stabilizing solution to be used for the stabilizing processing step is a processing liquor for stabilization of the dye image formed on the light-sensitive material, and it may contain a chelating agent for a metal ion. And the stopping solution, the rinsing solution and the amplifying solution to be used for the processing step may be used solutions well-known in the art.

The different kinds of the light-sensitive materials of this invention may be most preferably a combination of a negative color film and a color paper, and the processing tanks for processing respectively the different kinds of light-sensitive materials should preferably be color developing processing tanks, and the tank for processing commonly the different kinds of light-sensitive materials preferably be the bleach-fixing processing tank and the stabilizing processing tank.

In this invention, when the procssing tank for processing commonly the different kinds of light-sensitive materials is a bleach-fixing tank, the bleach-fixing solution to be used in the tank should preferably contain a ferric complex of an organic acid with a molecular weight of the organic acid of 300 or more.

Particularly preferble examples of organic acids having molecular weights of 300 or more are:

(1) Diethylenetriaminepentaacetic acid (Mw=393.27);
(2) Diethylenetriaminepentamethylenephosphonic acid (Mw=573.12);
(3) Cyclohexanediaminetetraacetic acid (Mw=364.35);
(4) Cyclohexanediaminetetramethylenephosphonic acid (Mw= 508.23);
(5) Triethylenetetraminehexaacetic acid (Mw=494.45);
(6) Triethylenetetraminehexamethylenephosphonic acid (Mw=710.27);
(7) Glycoletherdiaminetetraacetic acid (Mw=380.35);
(8) Glycoletherdiaminetetramethylenephosphonic acid (Mw=524.23);
(9) 1,2-Diaminopropanetetraacetic acid (Mw=306.27);

(10) 1,2-Diaminopropanetetramethylenephosphonic acid (Mw=450.15);
(11) 1,3-Diaminopropane-2-ol-tetraacetic acid (Mw=322.27);
(12) 1,3-Diaminopropane-2-ol-tetramethylenephosphonic acid (Mw=466.15);
(13) Ethylenediamine-di-ortho-hydroxyphenylacetic acid (Mw=360.37);
(14) Ethylenediamine-di-ortho-hydroxyphenylmethylenephosphonic acid (Mw=432.31); and
(15) Ethylenediaminetetramethylenephosphonic acid (Mw=436.13).

The organic acid to be used for the organic acid ferric complex of this invention may be any one selected from among these organic acids, or, if desired, two or more organic acids may be used in combination.

Among the organic acids for forming the organic acid ferric complexes of this invention, particularly preferable organic acids are:

(I) diethylenetriaminepentaacetic acid;
(II) Cyclohexanediaminetetraacetic acid; and
(III) Glycoletherdiaminetetraacetic acid.

The ferric complexes of the aforesaid organic acids may be used in the form of free acids (hydrogen salts), alkali metal salts such as sodium salts, potassium salts and lithium salts, or ammonium salts or water-soluble salts such as triethanolamine salts, preferably in the form of potassium salts, sodium salts or ammonium salts. Although it is sufficient to use at least one kind of these ferric complexes, two or more kinds of complexes may also be used i combination. The amount of the complex employed can be chosen as desired, and is required to be chosen depending on the silver quantity and the silver halide composition of the light-sensitive material to be processed, but generally at a lower concentration than other aminopolycarboxylic acid salts due to higher oxidative power. For example, it can be used in an amount of 0.01 mole or more, preferably 0.05 to 0.6 mole, per liter of the liquor employed. In the supplemental liquor, it should be used in a high concentration up to the solubility for a concentrated liquor at a low level of supplementation.

The stabilizing liquor according to this invention is preferably employed in this invention, because both of the compactness of the automatic processer and the storability of the dye images of two different kinds of light-sensitive materials (e.g. negative film and paper) are good during processing with said stabilizing liquor after a processing liquor having fixing ability such as fixing solution, bleach-fixing solution, etc., without passing through substantial step of washing with water.

Also, the stabilizing liquor of this invention should particularly preferably contain at least one selected from the group of compounds shown below, since the effect of this invention can excellently be exhibited, with additional effects of improvement of generation of silver sulfide in said stabilizing liquor during a long term of processing with low frequency of renewal as well as improvement of the stain at the unexposed portion of the processed light-sensitive material.

Compounds (A) Benzoic acid ester compounds;
(B) Phenolic compounds;
(C) Thiazoline compounds;
(D) Imidazole compounds;
(E) Guanidine compounds;
(F) Carbamate compounds;
(G) Morpholine compounds;
(H) Quaternary phosphonium compounds;
(I) Quaternary ammonium compounds;
(J) Urea compounds;
(K) Isoxazole compounds;
(L) Propanolamine compounds;
(M) Amino acid compounds;
(N) Triazine compounds; and
(O) Pyridine compounds.

In this invention, when the processing tank for processing commonly the different light-sensitive materials is a stabilizing tank, it is preferred that the stabilizing liquor to be employed should contain at least one of compounds (A) to (O) below.

(A) Benzoic acid ester compounds;
(B) Phenolic compounds;
(C) Thiazoline compounds;
(D) Imidazole compounds;
(E) Guanidine compounds;
(F) Carbamate compounds;
(G) Morpholine compounds;
(H) Quaternary phosphonium compounds;
(I) Quaternary ammonium compounds;
(J) Urea compounds;
(K) Isoxazole compounds;
(L) Propanolamine compounds;
(M) Amino acid compounds;
(N) Triazine compounds; and
(O) Pyridine compounds.

Typical exemplary compounds of the above-mentioned compounds (A) to (0) to be contained in the stabilizing liquor of this invention are set forth below, but this invention is not limited thereto.

Exemplary compounds (1) Sodium o-phenylphenolate;
(2) 2-Octyl-4-isothiazoline;
(3) Benzisothiazoline-3-one;
(4) 2-Methyl-4-isothiazoline-3-one;
(5) 5-Chloro-2-methyl-4-isothiazoline-3-one;
(6) 2-Thiomethyl-4-ethylamino-6-(1,2-dimethylpropylamino)-s-triazine;
(7) Hexahydro-1,3,5-tris(2-hydroxyethyl)-s-triazine;
(8) 4-(2-Nitrobutyl)morpholine;
(9) 4-(3-Nitrobutyl)morpholine;
(10) 2-(4-Thiazolyl)benzimidazole;
(11) Dodecylguanidine hydrochloride;
(12) Methyl hydroxybenzoate;
(13) Propyl hydroxybenzoate;
(14) n-Butyl hydroxybenzoate;
(15) Isobutyl hydroxybenzoate;
(16) Methyl benzoate;
(17) o-Cyclohexylphenol;
(18) 1,2-Benzisothiazoline-3-one;
(19) 2-Octyl-4-isothiazoline-3-one;
(20) 2-(4-Thiazolyl)-benzimidazole;
(21) 2,6-Dimethylpyridine;
(22) 2,4,6-Trimethylpyridine;
(23) Sodium-2-pyridinethiol-1-oxide;
(24) Cyclohexidine;
(25) Polyhexmethylenebiguanidine hydrochloride;
(26) Methyl-1-(butylcarbamoyl)-2-benzimidazole carbamate;
(27) Methylimidazole carbamate;
(28) Tri-n-butyl-tetradecylphosphonium chloride;
(29) Triphenylnitrophenylphosphonium chloride;
(30) Dodecyldimethylbenzylammonium chloride;

(31) Didecyldimethylammonium chloride;
(32) Laurylpyridinium chloride;
(33) N-(3,4-Dichlorophenyl)-N'-(4-chlorophenyl)urea;
(34) N-(3-trifluoromethyl-4-chlorophenyl)-N'-(4-chlorophenyl)urea;
(35) 3-Hydroxy-5-methyl-isoxazole;
(36) D,L-2-benzylamino-1-propanol;
(37) 3-Diethylamino-1-propanol;
(38) 2-Dimethylamino-2-methyl-1-propanol;
(39) 3-Amino-1-propanol;
(40) Isopropanolamine;
(41) Diisopropanolamine;
(42) N,N-dimethylisopropanolamine; and
(43) N-luryl-8-alanine.

Of the above antimicrobial agents, tee compounds to be used preferably in this invention are thiazoline compounds, pyridine compounds, guanidine compounds and quaternary ammonium compounds. Above all, thiazoline compounds are particularly preferred.

The amount of the compounds (A) to (0) of this invention to be added in the stabilizing liquor is used in an amount within the range from 0.002 g to 50 g, preferably from 0.005 g to 10 g per liter of the stabilizing liquor, because no effect of this invention can be exhibited at a level lower than 0.002 g, while an amount over 50 g is not desirable in view of the cost.

The pH of the stabilizing liquor to be used in this invention is not particularly limited, but preferably within the range from pH 0.5 to 12.0, more preferably from pH 5.0 to 9.0, particularly preferably from pH 6.0 to 9.0.

The pH controller which can be contained in the stabilizing liquor of this invention may be any of alkali agents or acid agents generally known in the art, but it is preferred to use a small amount of such agents for accomplishing the objects of this invention.

This invention is described in detail by referring to the following Examples.

EXAMPLE 1

Figure 2:
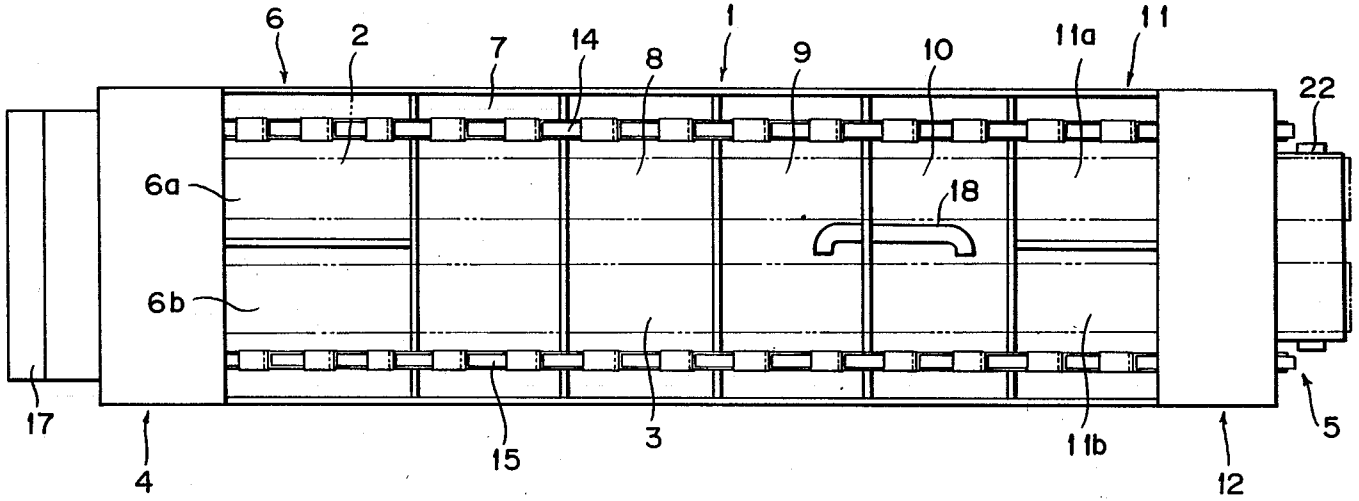
FIG. 2 is plan view of the automatic processer in FIG. 1.
Figure 3:
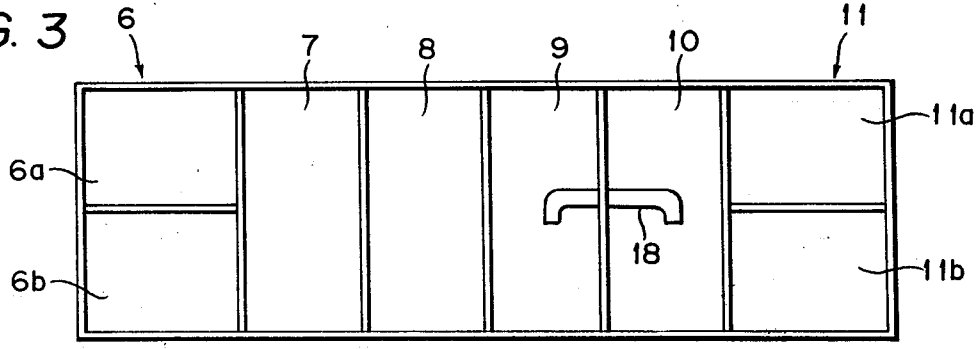
FIG. 3 is a plan view of a processing tank.
Figure 4:
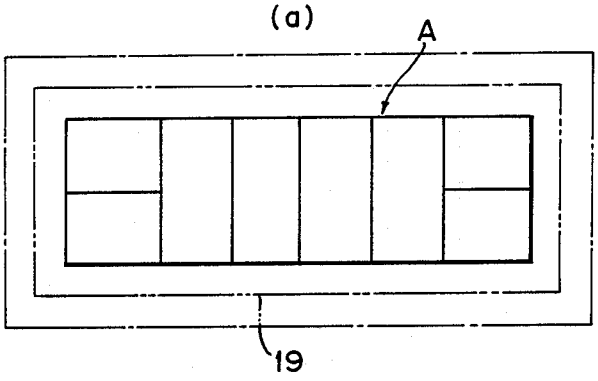
FIG. 4 is a plan view exhibiting the state in which the automatic processer is installed.
Figure 4:
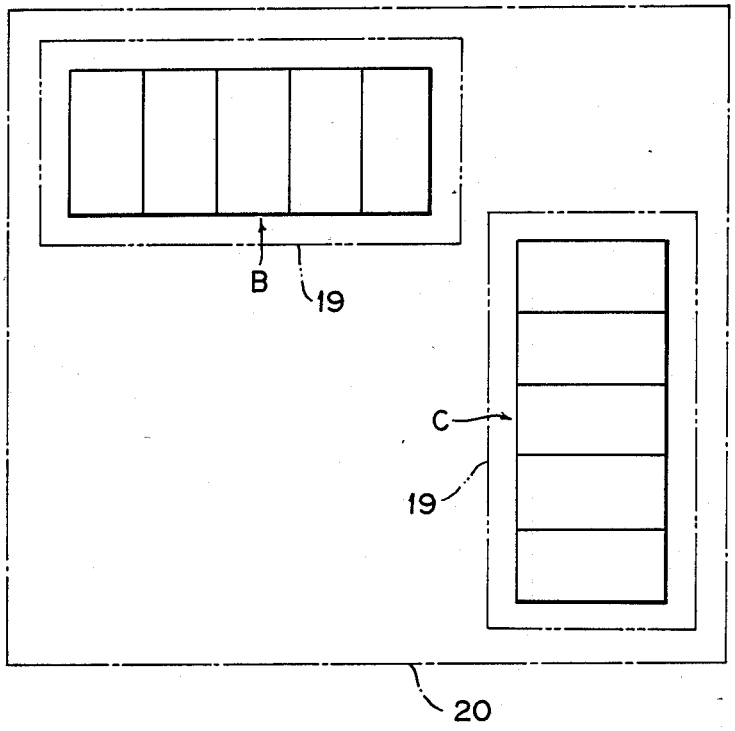

FIG. 1 is a sectional view of the automatic processer, FIG. 2 is a plan view of the automatic processer, FIG. 3 is a plan view of the processing liquor tank and FIG. 4 shows a plan view of the state in which the automatic processer is set.

In FIG. 1, the mark 1 shows the body of the processer, and the processer body 1 is equipped at its front side with a feeding section 4 for feeding a negative light-sensitive material 2 of an undeveloped negative color film or a positive light-sensitive material 3 of a color paper, and at its back side with a removing section 5 for removing the processed light-sensitive materials 2 and 3, respectively.

Between the feeding section 4 and the removing section 5, namely at the inner portion of the processer body 1, there are arranged successively from the feeding section side to the removing section, adjacent to each other, a developer tank 6, a bleaching liquor tank 7, a fixing liquor tank 8, first stabilizing liquor tanks 9 and 10, a second stabilizing tank 11 and drying section 12.

In these processing liquor tanks 6, 7, 8, 9, 10, 11 and the drying section 12, there are arranged a number of guide rollers 13.

Around the guide rollers 13 are hung a pair of endless belts 14, 15 which are a pair of conveying carriers, and the endless belt 14 conveys the positive light-sensitive material 2, while the endless belt 15 the negative light-sensitive material 3. Each of these endless belts 14 and 15 is devised to be driven by the driving motor 16 equipped on the feeding section side.

At the above-mentioned feeding section 4 is arranged a holding section 17, at which hold section 17 is set the undeveloped negative light-sensitive material 2 or the positive light-sensitive material 3. And, the light-sensitive material 2 or the light-sensitive material 3 is supported at its end through a clip which is not shown on the above endless belt 14 or 15 and conveyed through driving with the endless belt 14 or 15.

The above-mentioned developer tank 6, the bleaching liquor tank 7, the fixing liquor tank 8, the first stabilizing liquor tanks 9 and 10, and the second stabilizing liquor tank 11 are constituted as shown in FIG. 3. Thus, the developer tank 6 is constituted of a negative developer tank 6a and a positive developer tank *6b*, which are filled with developers for respective uses. The negative light-sensitive material 2 is processed in the negative developer tank *6a* separately from the positive light-sensitive material 3 which is processed in the positive developer tank *6b* so that the photographic performance may be exhibited to the greatest extent.

The processing tanks situated at the later stages than the developer tank 6, namely the bleaching liquor tank 7, the fixing liquor tank 8, and the first stabilizing tanks 9 and 10 are each constituted of a single tank.

The second stabilizing tank 11 is constituted of a negative stabilizing liquor tank *11a* and a positive stabilizing liquor tank *11b*. In this case, either one of the negative stabilizing liquor tank lla r the positive stabilizing liquor tank *11b* may be omitted. Thus, the stabilizing processing of the light-sensitive material is effected with a stabilizing liquor without washing water, whereby water is rendered unnecessary, and yet no provision of a water discharging pipe is required and, therefore, the place for setting the machine is not particularly limited.

A cascade pipeline 18 is provided between the first stabiiizing liquor tanks 9 and 10, and the supplemental liquor supplemented to the first stabilizing liquor tank 10 at the later stage, when it is overflown, flows into the first stabilizing liquor tank 9 at the previous stage. With such a constitution, the stabilizing liquor overflown can be further utilized to enhance the efficiency of the stabilizing processing. Of course, the stabilizing liquor tank can be made not only to one tank in place of two tanks, but also to three tanks depending on the case.

This automatic processer, as shown in FIG. 4(a), even when ensuring a working space 19 therearound, since it requires no space for two automatic processers B, C for the negative light-sensitive material or the positive light-sensitive material 3, can reduce its installation area 20 to a great extent.

Next, actuation of this Example is explained.

When subjecting an undeveloped negative light-sensitive material 2 to developing processing, the magazine 21 housing the negative light-sensitive material 2 is set on the holding section 17, and the light-sensitive material 2 is conveyed, while being supported on the endless belt 14 through the clip which is not shown. And, the material is processed in the negative developer tank *6a*, then in the common bleaching liquor tank 7, the fixing liquor tank 8, the first stabilizing liquor tanks 9 and 10, and conveyed from the stabilizing liquor tank 11 for exclusive use for negative to the drying section, during which the developing processing is effected. The processed negative light-sensitive material 2 is separated from the endless belt 14 at the removing section 5, and wound up on a wind-up reel 22.

On the other hand, when the undeveloped positive light-sensitive material 3 is subjected to developing processing, the magazine housing the positive light-sensitive material 3 therein is set on the holding section 17, and the light-sensitive material 3 is conveyed, while being supported at its tip end by means of a clip on the other endless belt 15. And, it is developed in the posi-developer tank 6*b*, followed by processings similarly as described above.

In the above description, the conveying mechanism for the above light-sensitive materials employed the same endless belts 13 and 14, but any other conveying mechanism conventionally employed may be available. For example, any other method such as the friction drive system by means of fixed rollers, the leader conveying system, chain conveying system, etc. may be utilized. Also, the mechanisms employed for conveying the negative light-sensitive material 2 and the positive light-sensitive material 3 through the processing tanks may also be different from each other. For example, as one desirable system, the negative light-sensitive material 2 may be conveyed through the short leader system, while the positive light-sensitive material 3 is conveyed through the above-mentioned endless belt conveying system.

Further, when the negative light-sensitive material 2 and the positive light-sensitive material 3 are processed in the common processing tank, liquid circulation through the common processing tank may be possible with one pump, and the liquid can be introduced into the pump from any portion of the common processing liquor, and the liquid can be delivered to any portion of the liquor. In feeding to the processing liquor, it is desirable to employ a system in which stirring effect is caused according to the system in which the liquid to be fed is blasted directly against the surface of the processing liquor.

The circulation pump is required for the purpose of stirring and temperature control, as described above, but the amount of the liquor to be circulated may be the minimum necessary for such purposes. Two circulation pumps required for the negative light-sensitive material 2 and the positive light-sensitive material 3, respectively, in the prior art can be reduced to one common pump.

Stabilizing liquor tanks are arranged in place of the water washing tank, and the stabilizing liquor is capable of processing with a supplemental amount of about 1/100 to 1/5 of the washing water of the prior art and the color image can be stabilized to the extent not inferior to washing with water. Thus, the pipelines for water can be omitted, since having no washing water tank, the automatic processer can be located at any desired place, because no special piping work is required.

EXAMPLE 2

Figure 5:
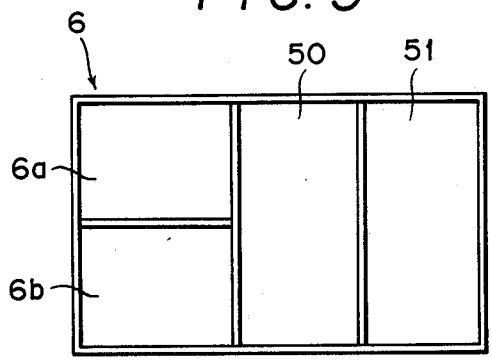
FIG. 5 is a sectional view of another embodiment of the automatic processer according to this invention.

FIG. 5 shows a structure in which the processing liquor tank 6 for exclusive use is constituted of the negative developer tank 6*a* and the positive developer tank 6*b*, and the common processing liquor tank for general purpose is constituted of two different stabilizing liquor tanks 50 and 51. This is practiced in the case when both or one of the negative developer and the positive developer is one developing-fixing solution or one developing-bleach-fixing solution, and only the different stabilizing liquor tanks are attempted to be made common.

EXAMPLE 3

Figure 6:
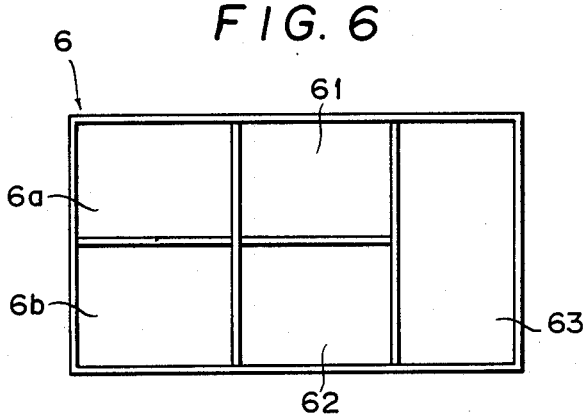
FIG. 6 is a sectional view of still another embodiment of the automatic processer according to this invention.

FIG. 6 shows a structure, in which a bleach-fixing solution tank 61 is arranged at the later stage subsequent to the negative developer tank 6*a* in the developing processing step of the negative light-sensitive material. According to this embodiment, since processing is performed with one bleach-fixing tank 61 after the developing processing, the circulation pump or the temperature controlling meter for the processing liquor can further be saved.

In the developing processing step of the positive light-sensitive material, amplifying processing is performed by use of a peroxide such as hydrogen peroxide with an amplifying liquor tank 62 arranged at the later stage subsequent to the positive developer tank 6*b*. According to this embodiment, since the quantity of silver applied on the positive light-sensitive material is small, the bleaching step or the bleach-fixing step can be obviated. A stabilizing liquor tank 63 is provided as a general purpose processing tank.

EXAMPLE 4

Figure 7:
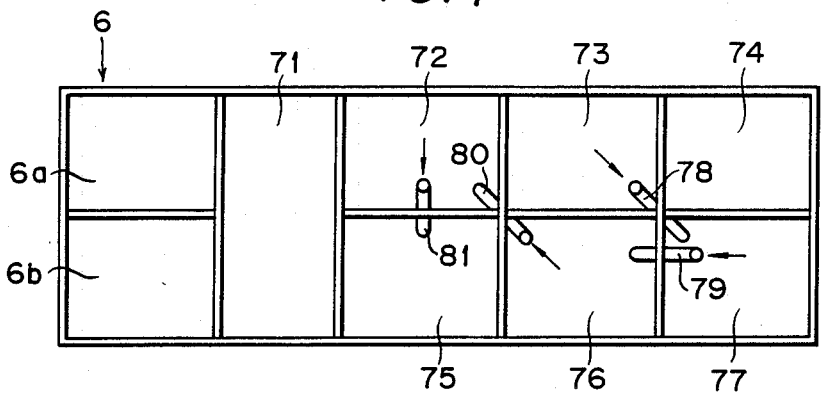
FIG. 7 is a sectional view of still another embodiment of the automatic processer according to this invention.

FIG. 7 shows a structure in which a bleach-fixing liquor tank 71, the first stabilizing liquor tanks 72 and 73 and the second stabilizing liquor tank 74 are arranged in the later stage subsequent to the negative developer tank 6*a* in the developing processing step of negative light-sensitive material. On the other hand, in the developing processing step of positive light-sensitive material, the aforesaid bleach-fixing liquor tank 71, the first stabilizing liquor tanks 75, 76 and 77 are arranged, respectively, at the later stage subseuent to the positive developer tank 6*b*. A cascade pipline 78 is arranged between the first stabilizing liquor tanks 73 and 77, a cascade pipeline 79 between the first stabilizing liquor tanks 77 and 76, a cascade pipeline 80 between the first stabilizing liquor tanks 76 and 72 and further a cascade pipeline 81 between the first stabilizing liquor tanks 72 and 75. Accordingly, when a first stabilizing liquor is supplemented into the first stabilizing liquor tank 73 in the developing processing step of negative light-sensitive material, the liquor will be overflown through the cascade pipelines 78, 79, 80 and 81 to be supplemented into the first stabilizing liquor tanks 73, 77, 76, 72 and 75 in the order mentioned. By such an arrangement, the degree of washing in the first stabilizing liquor tanks 72, 73 in the negative developing processing step is constantly made higher than that in the first stabilizing liquor tanks 75, 76 and 77 in the developing processing step of the positive light-sensitive material.

EXAMPLE 5

On a triacetate film base are provided a halation prevention layer and a gelatin layer, on which a red-sensitive silver halide emulsion layer, a green-sensitive silver halide emulsion, a filter layer containing yellow colloidal silver and a blue-sensitive silver halide emulsion layer were applied in the total silver quantity of 70 mg/100 $cm^2$. The above emulsion layer is a silver iodobromide with about 4.5 mole % of silver iodide, in which there were employed α-(4-nitrophenoxy)-α-pivalyl-5-[γ-(2,4-di-t-aminophenoxy)butylamido]-2-chloroacetanilide as the yellow coupler in the blue-sensitive silver halide emulsion layer, 1-(2,4,6-trichlorophenyl)-3-}[α-(2,4-di-t-amylphenoxy)-acetamido]benzamido)-3-pyrazolone and 1-(2,4,6-trichlorophenyl)-3-}[α-(2,4-di-t-amylphenoxy)-acetamido]benzamido)-4-

(4-methoxyphenylazo)-5-pyrazolone as the magenta couplers in the green-sensitive silver halide emulsion layer and 1-hydroxy-N-}α-(2,4,t-amylphenoxy)butyl)-2-naphthoamide as the cyan coupler in the red-sensitive silver halide emulsion layer. In each emulsion layer were added additives such as dye sensitizers, film hardeners and extenders, respectively. Thus, a color film sample was prepared.

Also, a resin-coated paper substrate was coated with a coupler prepared by dissolving 2-(1-benzyl-2,4-dioxyimidazolidin-3-yl)-2-pivalyl-2'-chloro-5'-[4-(2,4-di-tpentylphenoxy)butaneamido]acetanilide in dibutylphthalate, subjecting the solution to protective dispersion in an aqueous gelatin solution and mixing the dispersion with a silver chlorobromide emulsion. The amount of the coupler employed per 100 $cm^2$ was 24 mg and the silver 0.85 mg. On this coating a gelatin intermediate layer containing dioctylhydroquinone, and a coupler prepared by dissolving 3-(2-chloro-5-[1-(octanedecyl)-succinimido]anilino)-1-(2,4,6-trichlorophenyl)-5-pyrazolone in dibutylphthalate, subjecting the solution to protective dispersion in an aqueous gelatin solution and thereafter mixing the dispersion with a green-sensitive silver chlorobromide emulsion, was coated and dried. The amount of the coupler employed per 100 $cm^2$ was 49 mg, and the silver 0.87 mg. On this layer was applied by coating a color turbidity prevention layer of a gelatin solution of dioctylhydroquinone, followed further by coating and drying of a coupler, which was prepared by dissolving 2-[2-(2,4-di-t-pentylphenoxy)butaneamido]-4,6-dichloro-5-methylphenol in dibutylphthalate, subjecting the solution to protective dispersion in an aqueous gelatin solution and mixing the dispersion with a red-sensitive silver chlorobromide emulsion. The amount of the coupler coated per 100 $cm^2$ was 30 mg, and the silver 0.75 mg.

As described above, a color paper sample was prepared.

These samples, after application of exposure in conventional manner, were subjected to processings as described below.

| Processing step | Temperature (°C.) | Time |
|---|---|---|
| (Color negative processing) | | |
| 1. Color developing | 38.0 | 3 min. 15 sec. |
| 2. Bleach-fixing (Common) | 38.0 | 6 min. |
| 3. First stabilizing (Common) | 32.0 | 2 min. |
| 4. Second stabilizing | 32.0 | 1 min. |
| (Color paper processing) | | |
| 1. Color developing | 38.0 | 3 min. 15 sec. |
| 2. Bleach-fixing (Common) | 38.0 | 1 min. 30 sec. |
| 3. First stabilizing (Common) | 32.0 | 2 min. |

The color developing solutions employed had the compositions as shown below:

| [For color paper processing] | |
|---|---|
| Benzyl alcohol | 16 ml |
| Diethylene glycol | 16 ml |
| Fluorescent whitening agent (Note*) | 2 g |
| Hydroxylamine sulfate | 4 g |
| 3-Methyl-4-amino-N—ethyl-N—(β-methanesulfonamidoethyl)aniline sulfate | 5 g |
| Potassium carbonate | 25 g |
| Potassium sulfite (50% solution) | 5 ml |

-continued

| | |
|---|---|
| Potassium bromide | 1.1 g |
| Potassium chloride | 0.5 g |
| Potassium hydroxide | 2.9 g |
| (made up to one liter with water, pH 10.2) | |

| [Supplemental color developing solution for paper processing] | |
|---|---|
| Benzyl alcohol | 20 ml |
| Diethylene glycol | 20 ml |
| Flourescent whitening agent (Note*) | 2 g |
| Hydroxylamine sulfate | 4 g |
| 3-Methyl-4-amino-N—ethyl-N—(β-methanesulfonamidoethyl)aniline sulfate | 7.0 g |
| Potassium carbonate | 25 g |
| Potassium sulfite (50% solution) | 6 ml |
| Potassium bromide | 0.8 g |
| Potassium hydroxide | 2.3 g |
| (made up to one liter with water, pH 10.42) | |

| [Color developing solution for color negative film] | |
|---|---|
| Postassium carbonate | 30 g |
| Sodium hydrogen carbonate | 2.5 g |
| Potassium sulfite | 5 g |
| Sodium bromide | 1.3 g |
| Potassium iodide | 2 mg |
| Hydroxylamine sulfate | 2.5 g |
| Sodium chloride | 0.6 g |
| Sodium Diethylenetriaminepentaacetate | 2.5 g |
| 4-Amino-3-methyl-N—ethyl-N—(β-hydroxyethyl)aniline sulfate | 4.8 g |
| Potassium hydroxide | 1.2 g |
| (made up to one liter with water, and adjusted to pH 10.06 with potassium hydroxide or 20% sulfuric acid). | |

| [Supplemental color developing solution for color negative film] | |
|---|---|
| Potassium carbonate | 35 g |
| Sodium hydrogen carbonate | 3 g |
| Potassium sulfite | 7 g |
| Sodium bromide | 0.9 g |
| Hydroxylamine sulfate | 3.1 g |
| Sodium Diethylenetriaminepentaacetate | 3.2 g |
| 4-Amino-3-methyl-N—ethyl-N—(β-hydroxyethyl)aniline sulfate | 5.4 g |
| Potassium hydroxide | 2 g |
| (made up to one liter with water, and adjusted to pH 10.12 with potassium hydroxide or 20% sulfuric acid). | |

| [Bleach-fixing solution] (common) | |
|---|---|
| Iron (III) sodium ethylenediaminetetraacetate | 0.35 mole |
| Ammonium sulfite | 5.0 g |
| Ammonium thiosulfate | 150 g |
| Aqueous ammonia (28%) | 10 ml |
| (made up to one liter with water, and adjusted to pH 7.5 with acetic acid and aqueous ammonia). | |

| [Supplemental bleach-fixing solution] (common) | |
|---|---|
| Iron (III) sodium ethylenediaminetetraacetate | 0.4 mole |
| Ammonium sulfite | 10 g |
| Ammonium thiosulfate | 180 g |
| Aqueous ammonia (28%) | 10 ml |
| (made up to one liter with water, and adjusted to pH 7.0 with acetic acid and aqueous ammonia). | |

| [First stabilizing solution and supplemental first stabilizing solution] (common) | |
|---|---|
| 2-Methyl-4-thiazoline-3-one | 0.1 g |
| 1-Hydroxyethylidene-1,1-diphosphonic acid | 1.5 g |
| (made up to one liter with water, and adjusted to pH 7.0 with potassium hydroxide). | |

| Second stabilizing solution and supplemental second stabilizing solution] | |
|---|---|
| Formalin (37% solution) | 4 ml |
| 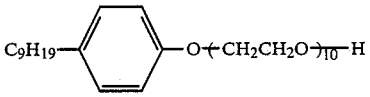 | 1 ml |

-continued (made up to one liter with water).

(Note*)
Cinopal MSP (produced by Ciba-Geigy CO.) was employed as the fluorescent whitening agent.

The supplemental color developing solution was supplemented into the color developing bath in an amount of 15 ml per 100 $cm^2$ for the color negative film and 3.2 ml per 100 $cm^2$ for the color paper, and the supplemental bleach-fixing solution into the bleach-fixing bath in an amount of 8.0 ml per 100 $cm^2$ of the light-sensitive material. The supplemental first and second stabilizing solutions were each supplemented in an amount of 10 ml per 100 $cm^2$ of the light-sensitive material. The amount of processing was 2.0 $m^2$/day for the above color negative film, while that for the above color paper was 12 $m^2$/day. Such processings were conducted continuously for 30 days. The thus obtained color negative films and color papers were subjected to compulsory deterioration tests under the high temperature and high humidity conditions of 80° C. and 60 RH % for 2 weeks. As the result, every light-sensitive material was found to be very small in generation of yellow stain.

We claim:

1. An automatic processor operable for simultaneous processing first and second different kinds of light-sensitive silver halide photographic material comprising a common processing tank for commonly processing said light-sensitive material first and second different kinds of processing tanks for processing respectively the first and second different kinds of light-sensitive silver halide photographic materials; and first and second conveying means operable for conveying said first and second different light-sensitive materials said first and second different kinds of processing tanks at the same time, while excluding said first light-sensitive material from said second tank and said second material from said first tank.

2. The automatic processor according to claim 1, wherein the first and second processing tanks and the common processing tank are provided in an integral combination.

3. The automatic processor according to claim 1, further comprising a second common processing tank wherein the first and second processing tanks are color developing processing tanks, the common processing tank is a bleach-fixing tank and the second common processing tank is a stabilizing tank.

4. The automatic processor according to claim 1, wherein said processing tanks employ substantially no washing water.

5. The automatic processor according to claim 1, wherein the first conveying means is an endless belt and the second conveying means is an endless belt.

6. A process for automatically processing different kinds of photographic material including at least a first and a second kind of light-sensitive silver halide photographic materials, in an automatic processor having at least one kind of different processing tanks, one kind of shared processing tanks, and at least two conveying means each operable to convey either said first or said second kind of light sensitive photographic materials; said process comprising:

conveying said first kind of photographic materials through processing tanks containing first processing solutions for processing said first kind of photographic materials and simultaneously;

conveying said second kind of photographic materials through processing tanks containing second processing solutions for said second kind of photographic materials;

at least one of said first and said second processing solutions being the same solution and being in said shared processing tanks; and at least one of said first and said second processing solutions being different and being contained in said different processing tanks.

7. The process of claim 6, wherein at least one of said processing solutions is a bleach-fixing solution containing a ferric complex of an organic acid having a molecular weight of the organic acid of at least 300.

8. The process according to claim 7, wherein said ferric complex is iron (III) sodium ethylenediaminetetraacetate.

* * * * *